United States Patent [19]

Prozinski

[11] 4,155,204

[45] May 22, 1979

[54] EXPANDABLE MOBILE HOME

[76] Inventor: Robert S. Prozinski, Rte. 1, Box 134, Little Falls, Minn. 56345

[21] Appl. No.: 883,959

[22] Filed: Mar. 6, 1978

[51] Int. Cl.[2] ..... E04B 1/344; E04B 1/62

[52] U.S. Cl. ..... 52/69; 52/70; 52/71

[58] Field of Search ..... 52/69, 70, 71, 68, 67, 52/66; 49/383; 296/23 F, 23 G, 21

[56] References Cited

U.S. PATENT DOCUMENTS

| | | | |
|---|---|---|---|
| 2,155,876 | 4/1939 | Stout | 52/69 |
| 2,504,635 | 4/1950 | Bradley | 49/383 |
| 2,634,462 | 4/1953 | Graven | 52/69 |
| 2,995,785 | 8/1961 | Hallenbeck | 49/383 |
| 3,195,190 | 7/1965 | Malo | 52/69 |
| 3,408,102 | 10/1968 | McNamee | 52/69 |

FOREIGN PATENT DOCUMENTS

| | | | |
|---|---|---|---|
| 10831 of | 1892 | United Kingdom | 49/383 |

*Primary Examiner*—Reinaldo P. Machado
*Attorney, Agent, or Firm*—Merchant, Gould, Smith, Edell, Welter & Schmidt

[57] ABSTRACT

An improved expandable mobile home having hinged longitudinal joints between a central roof supported by a plurality of spaced sloping rafters and horizontally extending purlins secured on, and extending transverse to, the rafters, and maintained elevated by a plurality of aligned, spaced vertical posts, and a pair of folding roofs having a plurality of parallel extension rafters each corresponding to one of the spaced sloping rafters supporting the central roof, between a central floor and a pair of folding floors, and between the pair of folding floors and a pair of folding walls, and having hinged vertical joints between central end walls and pairs of folding end walls, the improvement residing in specific structures by which the mobile home is maintained in weather-tight state whether collapsed for transport or expanded for residence use. A particular feature of the invention lies in a weather sealer arrangement used between the central roof and the folding roofs: at each hinged joint a cavity is provided in the central roof and a flexible resilient sealer is secured to the folding roof for flexing and sliding in the cavity upon pivotal movement between the members. By preference, the sealer comprises a batt of flexible resilient material and a sheet of flexible impervious material fastened to that surface of the batt which becomes convex when the roof is folded.

3 Claims, 23 Drawing Figures

8A

II
IV
A
B
C
D
E
F
G

FIG. 10A
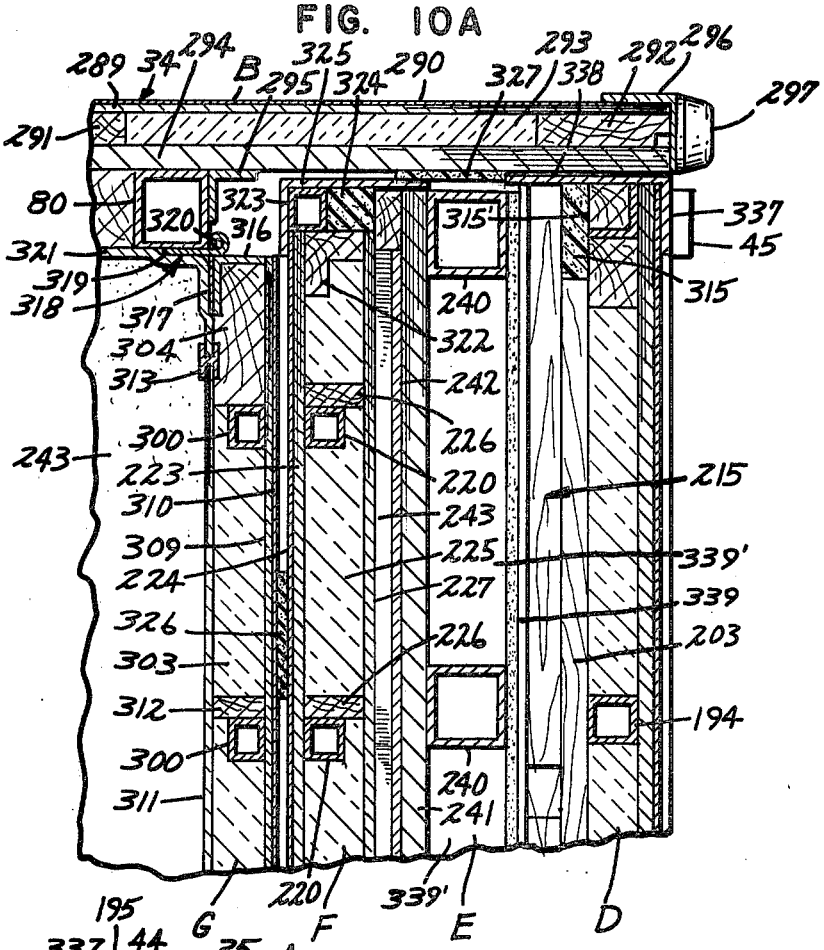
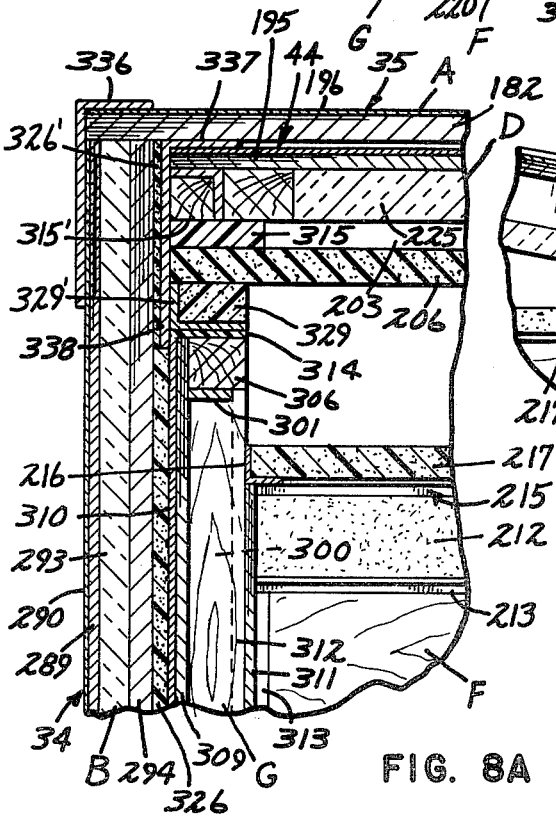
FIG. 8A
FIG. 21
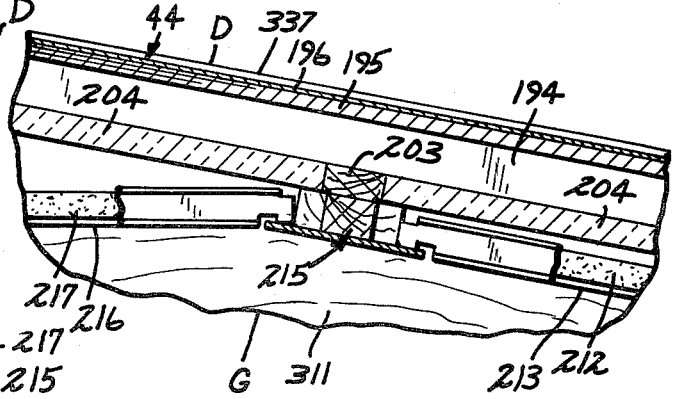

182
181
183
A
35
280
336
285
283
184
284
76
185
77
80
206
187
186
191
326'
124
281
207
327
190
192
193
113
236
235
237
245
233
234
335
232
337
122
203
81
311
306
222
244
195
123
G
309
227
243
242
211
204
44
362
223
224
226
196
240
D
220
F
225
128
326
243
E
241
194
313
210
80
305
310
242
272
197
74
318
275
B
276
C
319
274
278
201
271
242
277
338
274
200
202
270
273
279
287
286
287
45
36
288

EXPANDABLE MOBILE HOME

BACKGROUND OF THE INVENTION

This invention relates to the field of housing, and more particularly to housing facilities which are not fixed in site, but are designed for ready transport from one location to another. Structures os this type are frequently referred to as mobile homes: they are mounted on wheels and arranged to be towed behind a traction vehicle. Units of moderate size may be drawn behind a conventional motor car: traction power for larger units is best provided by a truck, or a tractor for commercial trailers.

There is a contradiction between the requirement of limited dimensions, set when a home of this sort is to be transported on public highways, and the requirement for adequate living space when the home is being used for residence. A solution previously proposed, and taught for example in Graven U.S. Pat. No. 2,634,462, is to design the structure as a expandable one, convertible from one form to another as the needs of the moment require.

A grave defect in such structures has heretofore been that by reason of the numerous hinges and other joints the structure is far from weather tight, even when in fixed locations. This leads not only to problems arising from the entry of dust and moisture into the structure during transport, but also to serious heat leakage through the numerous crevices the structure provides.

SUMMARY OF THE INVENTION

The present invention is of an improved expandable mobile home having joints positioned intermediate a central roof supported by a plurality of sloping rafters and horizontally extending purlins secured on the rafters, and maintained elevated by a plurality of aligned spaced vertical posts, and an extension roof generally delineated by a plurality of parallel extension rafters, and also positioned intermediate a central floor and a folding floor, a folding floor and a folding wall, and a central end wall and a folding end wall. Said joints are specially constructed to give a structure which is weather and dust tight whether collapsed and in transit, or expanded and in residence use. This is accomplished by designing a structure in which each hinged or other joint is provided with specific sealing means to prevent ingress of the ambient air or egress of internal air, in combination with means by which the movement of the vehicle can cause admission of air to the structure, through appropriate filters, to dynamically keep its internal pressure slightly above the ambient pressure.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing,

FIG. 8A is a fragmentary view in vertical section along the line 8A—8A of FIG. 8;

FIG. 10A is a view like FIG. 10 but showing the structure in its collapsed condition;

FIG. 21 is an enlarged vertical sectional view of the portion of the structure indicated by the circle at 21 in FIG. 20.

BRIEF DESCRIPTION OF THE PREFERRED EMBODIMENT

Figure 1:
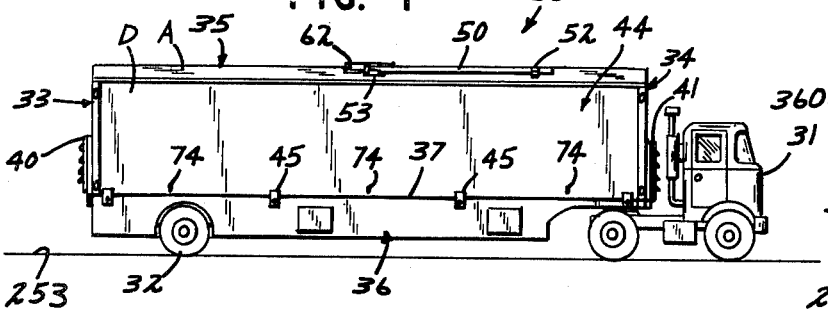
FIG. 1 is a side view of my expandable mobile home, shown in its collapsed condition for transport and coupled to a traction vehicle.
Figure 2:
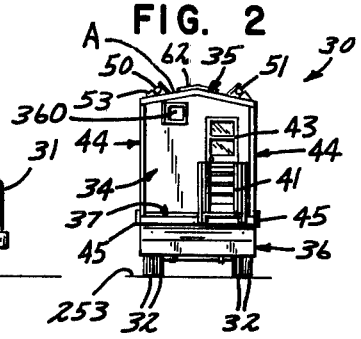
FIG. 2 is a front view of the same structure to the same scale, the traction vehicle being omitted.

A general view of a mobile home 30 embodying my invention is given in FIGS. 1 and 2, where the structure is shown in its collapsed condition for transport: it is removably coupled to a traction vehicle 31 for travelling as a trailer therebehind on its own wheels 32, of conventional construction and arrangement. The embodiment comprises an elongated structure having central gable ends 33 and 34, a central roof 35, and an undercarriage 36 containing the plumbing and heating accessories of the structure under a central floor 37 shown in later figures. Rear and front access means 40, 41 are folded against the ends of the structure in line with doors 42, 43 giving access to the interior.

Figure 18:
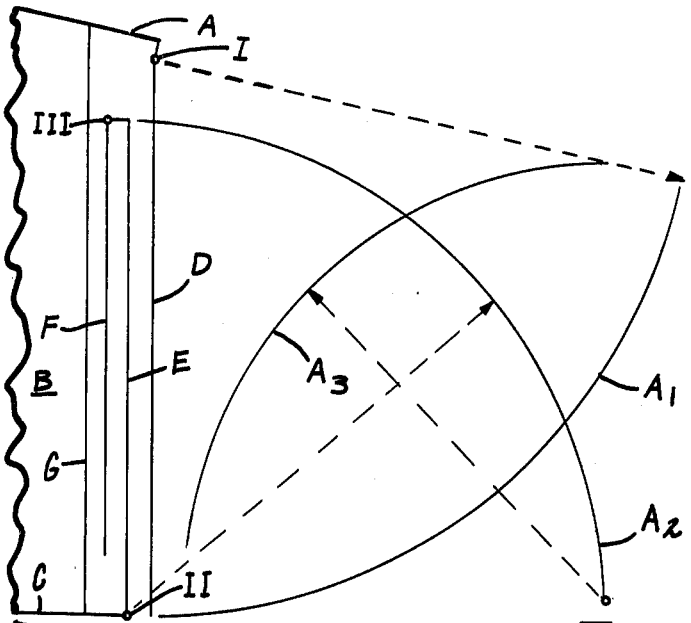
FIG. 18 and 19 are schematic views illustrative of the procedure for converting the structure between its two conditions.
Figure 19:
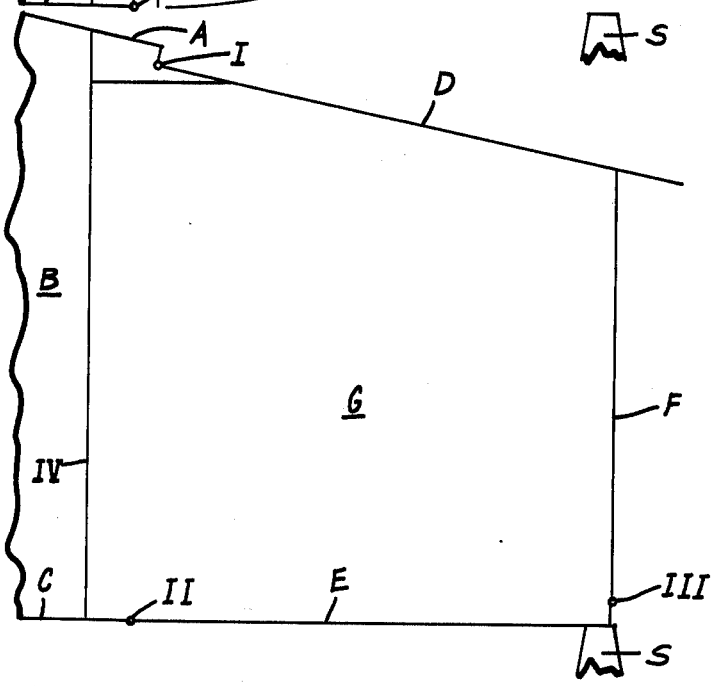

Before continuing with the description of the practical embodiment of my invention, reference should be had to FIGS. 18 and 19, which show the procedures by which my structure is expanded for stationary residence and collapsed for transport. The showings are schematic in that no thicknesses are shown, weather seals are omitted, and proportions are distorted to emphasize the principle involved. Since the four corners of the structure are the same, or mirror images, only one corner is shown in FIGS. 18 and 19, which disclose three fixed elements and four elements pivoted thereto.

In these figures a central roof A is fastened to a central end B and this to a central floor C of the undercarriage. A folding roof D is pivoted to the central roof A about a longitudinal horizontal "roof" axis I, a folding floor E is pivoted to the central floor C along a longitudinal horizontal "floor" axis II, a folding wall F is pivoted near its bottom to the outer edge of the folding floor E about a longitudinal horizontal "wall" axis III, and a folding end G is pivoted to the central end B about a vertical "end" axis IV.

To expand the structure from its collapsed position, shown in FIG. 18, folding roof D is opened by raising along arc $A_1$, folding floor E and folding wall F are opened as one by lowering along arc $A_2$ to rest on a prepared support S, folding wall F is opened by raising along arc $A_3$, folding end G is opened outwardly about axis IV, and folding roof D is lowered to hold components F and G in place, giving an expanded structure as shown in FIG. 19. Collapsing the structure is accomplished by the same procedures in reverse.

By the foregoing procedures the width of my structure may be reduced to about eight feet, for highway transportation, and increased to about twenty-five feet, to give ample space for residence occupancy. It is understood that any movable furniture used when the structure is expanded must be stored in the permanent central section when the structure is closed for transport.

Referring again to FIGS. 1 and 2, it will be evident that members 33, 34 there correspond to element B of FIGS. 18 and 19, that member 35 corresponds to element A, and that each visible side 44 corresponds to element D. These members are prevented from pivotal movement during transport by means including suitable clips 45 removably secured to undercarriage 36.

Figure 3:
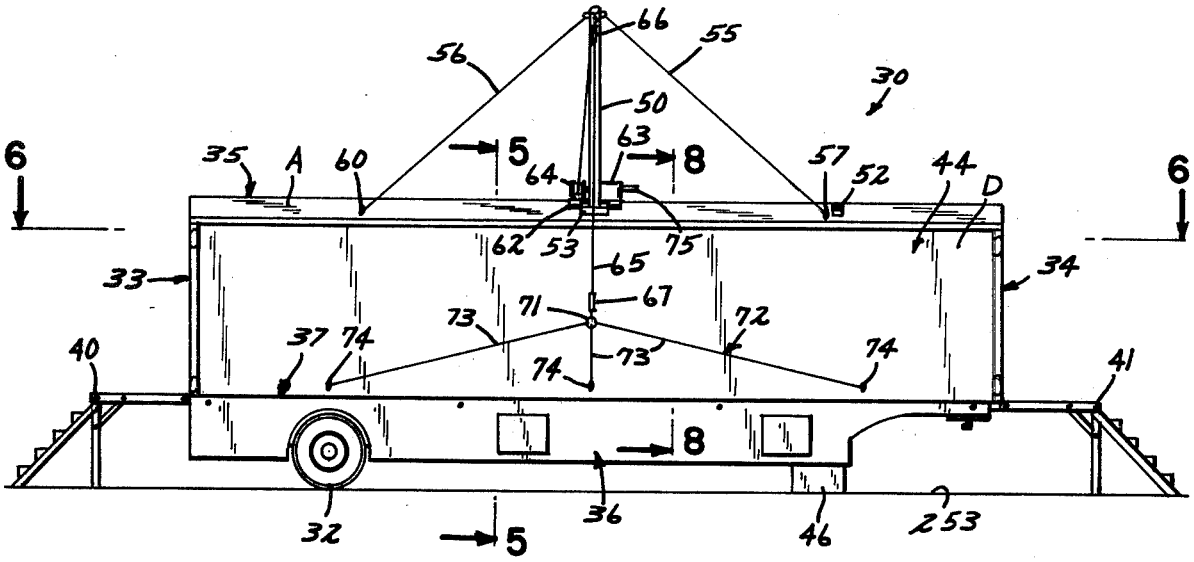
FIG. 3 is a side view, to a larger scale, of the mobile home uncoupled from its traction vehicle and in the process of being expanded.

As shown in FIG. 3, my mobile home 30 is disconnected from vehicle 31, being supported at the rear on its own wheels 32 and in front on suitable blocks 46. Access means 40 and 41 are shown as unfolded to their operative positions.

A pair of booms 50 and 51 are carried in suitable brackets on roof 35. Thus, one end of boom 50 is removably secured in a grip 52, and the other end is pivoted in a bracket 53 for movement about an oblique axis 54 which gives the boom a slope of about 45° with respect to the ground. A pair of guys 55 and 56 extend from the outer end of boom 50 to suitable forward and rearward anchors 57 and 60. A similar arrangement is provided for boom 51, and the booms are interconnected at their tops by a further guy 61.

A mounting plate 62 is secured to roof 35 between brackets 53 to removably receive a winch 63 having a drum 64 from which two cables 65 pass over first pulley blocks 66 fastened to the outer ends of booms 50 and 51, then through second pulley blocks 67, their ends being thereafter fastened at 70 to the booms. The hook of each block 67 enters the ring 71 of a harness 72 having cables 73 which engage hoisting eyes 74 in visible sides 44, which will be remembered to comprise extension roofs D of FIGS. 18 and 19.

Figure 4:
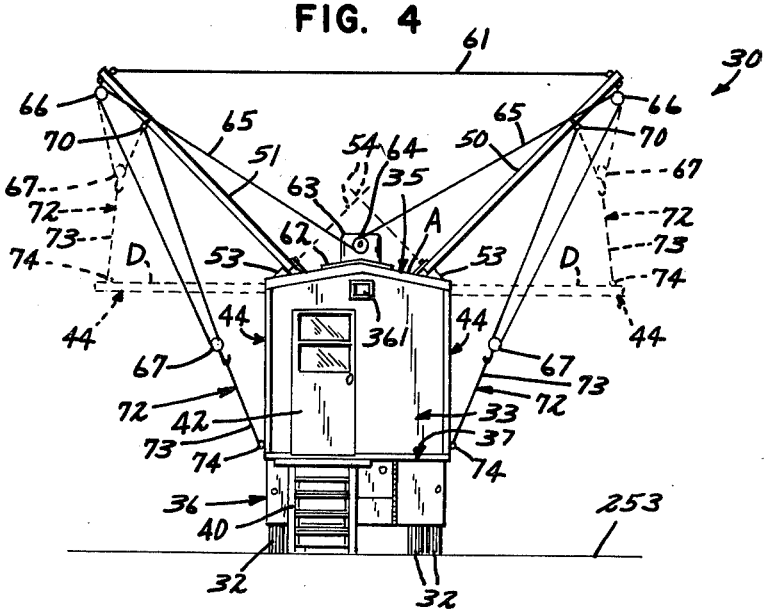
FIG. 4 is a rear view of the same structure to the same scale.

Winch 63 has a driving shaft 75 adapted to be received in the chuck of a portable power unit such as a half inch reversible power drill. Upon release of clips 45, shaft 75 may be driven, and sides 44 are hoisted from their solid line positions in FIG. 4 to those shown in broken lines. Winch 63 is provided with suitable brake or latch means so the sides 44 are retained in hoisted position, whereupon the power unit can be disconnected from winch 63 for another use presently to be explained.

Members 50–73 are of course stored except when the mobile home is being converted between its transport and residence conditions.

Figure 5:
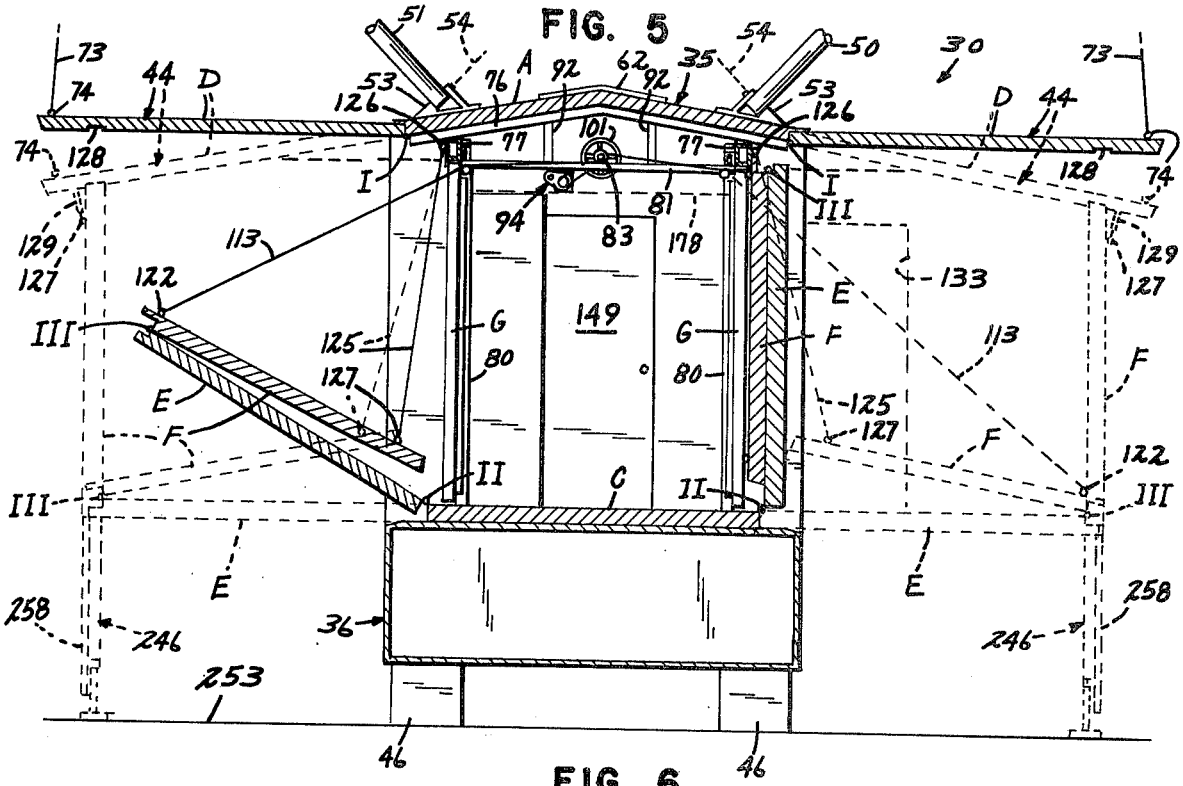
FIG. 5 is a schematic sectional view along the lines 5—5 of FIG. 3 to a still larger scale, showing various steps in the procedure for expanding the structure.
Figure 7:
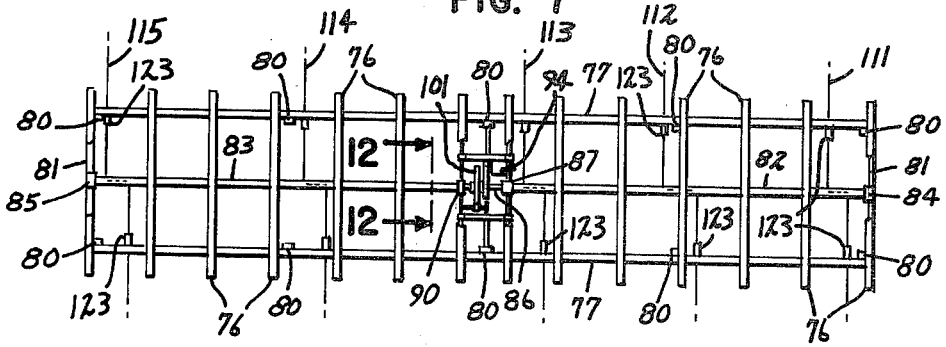
FIG. 7 is a fragmentary plan view to the same scale showing details of framework and mechanism used in expanding and collapsing the structure.
Figure 12:
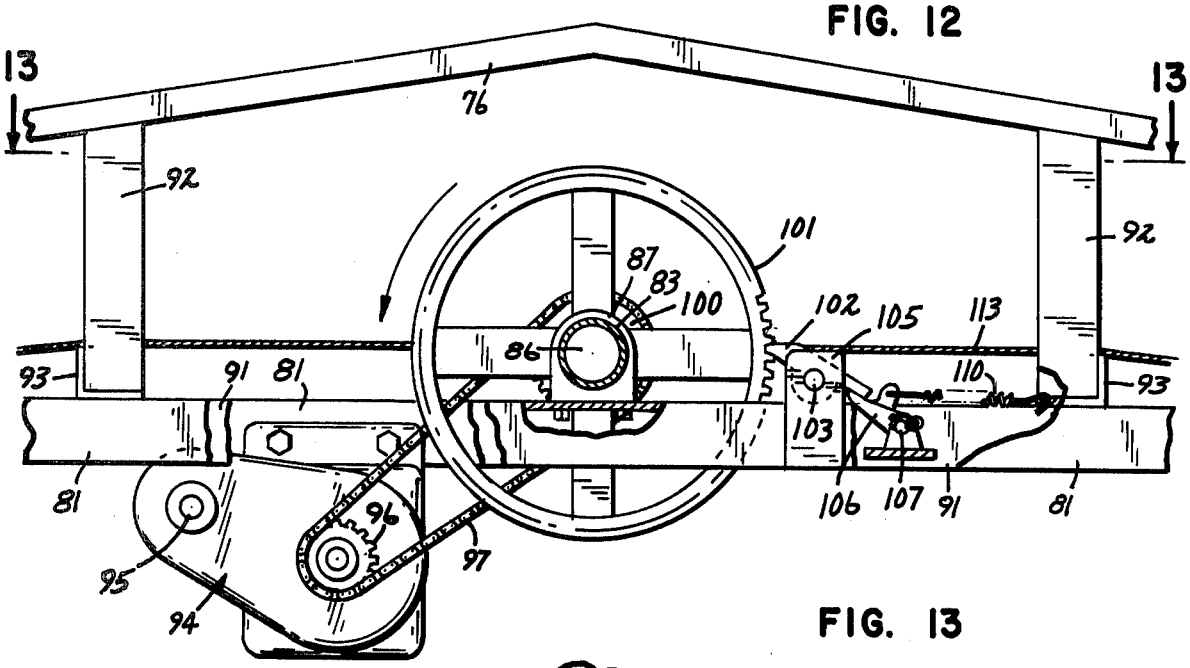
FIG. 12 is a fragmentary vertical sectional view along the line 12—12 of FIG. 7, portions thereof being omitted or broken away.

FIGS. 5 and 7 show that roof 35 is carried on transverse main rafters 76, which rest on plates 77 of rectangular tubular metal secured to the outer surfaces of the tops of support posts 80 positioned at intervals along the structure, and stringers 81 are provided to prevent spreading of the structure. A pair of coaxial shafts 82 and 83 are carried in end bearings 84 and 85; centrally, the shafts are coupled by a jack shaft 86 (FIGS. 12 and 13) carried in bearings 87 and 90 on a stringer 81 and a further cross member 91 respectively. The structure is supported by struts 92 and braces 93. Supported by member 91 and the adjacent stringer 81 is a gear reducer 94 having an input shaft 95 arranged to be driven by the power unit mentioned above, and an output sprocket wheel 96 coupled by a chain 97 to a driven sprocket wheel 100 fixed on jack shaft 86. Also fixed on shaft 86 is a ratchet wheel 101 engaged by a pawl 102 carried by a shaft 103 rotatable in bearings 104 and 105, and resiliently urged against wheel 101 by an arrangement including a finger 106 pivoted at 107 and a tension spring 110.

Figure 13:
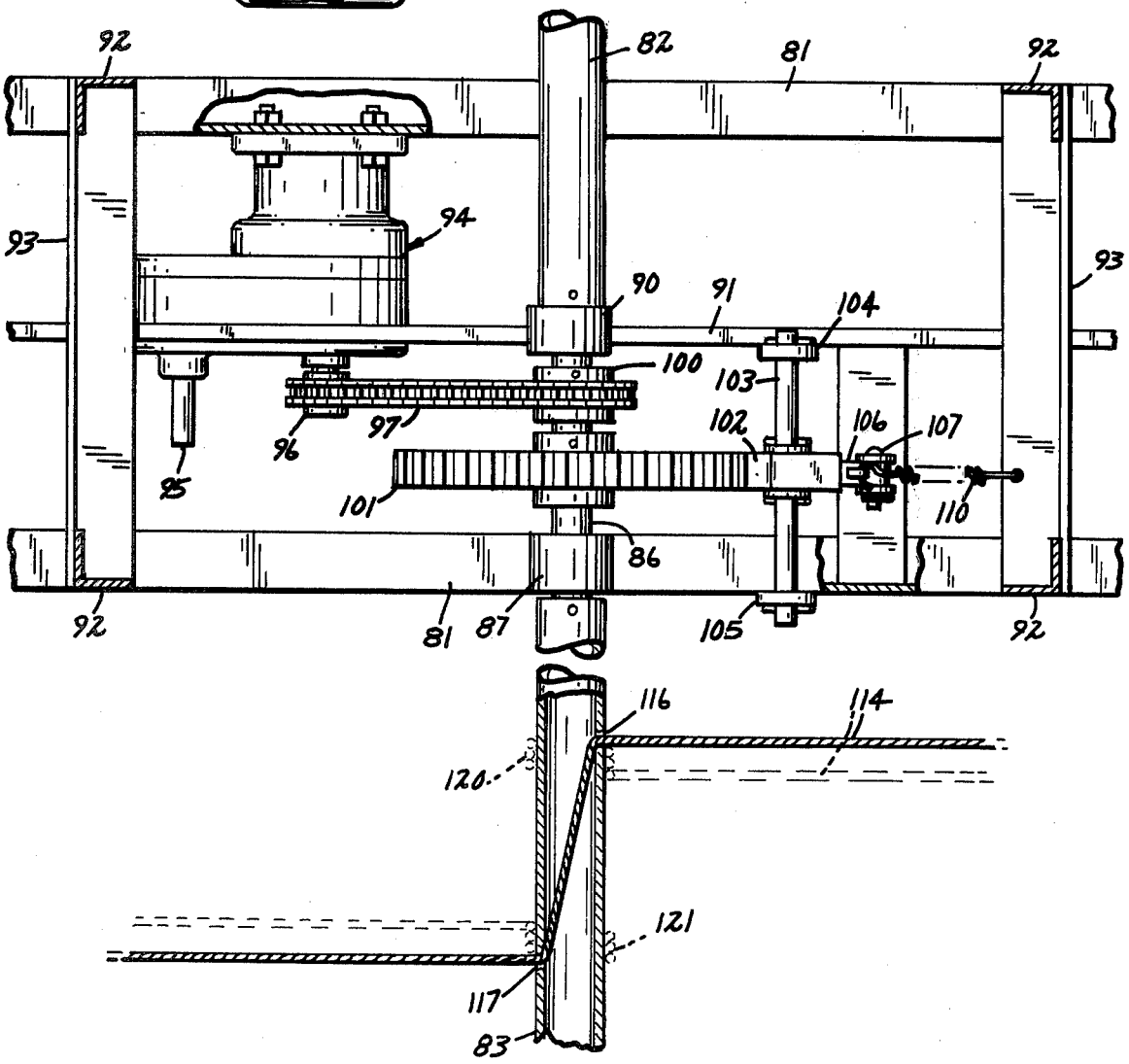
FIG. 13 is an enlarged horizontal sectional view of the structure taken along the line 13—13 of FIG. 12.

Referring against FIG. 7, shaft 82 acts as a set of drums for a plurality of cables 111, 112 and 113, and shaft 83 acts as a set of drums for a pair of cables 114 and 115. As shown in FIG. 13, the center of cable 114 passes through two outwardly rounded, diametrically opposite, axially spaced holes 116 and 117 in shaft 83, so that upon rotation of the shaft the cable forms a pair of wraps 120 and 121 around it. The other cables are similarly arranged. The ends of the cables are secured to hoisting eyes carried by members E, as will be seen in detail in FIG. 9, where cable 113 passes to hoisting eye bolt 122 over a pulley 123 mounted on post 80 by a bracket 124. When cables 111–114 are fully wound around shafts 82 and 83, elements E, F are held in vertical positions by pawl 102. When the power unit is chucked onto input shaft 95 and the pawl is released, operation in one direction lowers elements E and F as a unit to their horizontal positions to rest on supports S, while operation of the power unit in the other direction raises elements E and F as a unit to their vertical positions.

A dead-head cable 125 of fixed length is connected between eye bolts 126 and 127, and functions when element E approaches its horizontal position to lift the inner edge of element F enough to permit it to be gripped manually, and the element is light enough to be raised to the vertical without auxiliary power.

Although ordinarily both sides of the structure are raised or lowered at the same time, for clarity of explanation the full lines at the left hand side of FIG. 5 shows elements E and F partially lowered, while the broken lines at the left hand side shows the lowering completed: the full lines on the right hand side show elements E and F in folded raised condition, and the broken lines on the right hand side shown the fully expanded condition.

Figure 8:
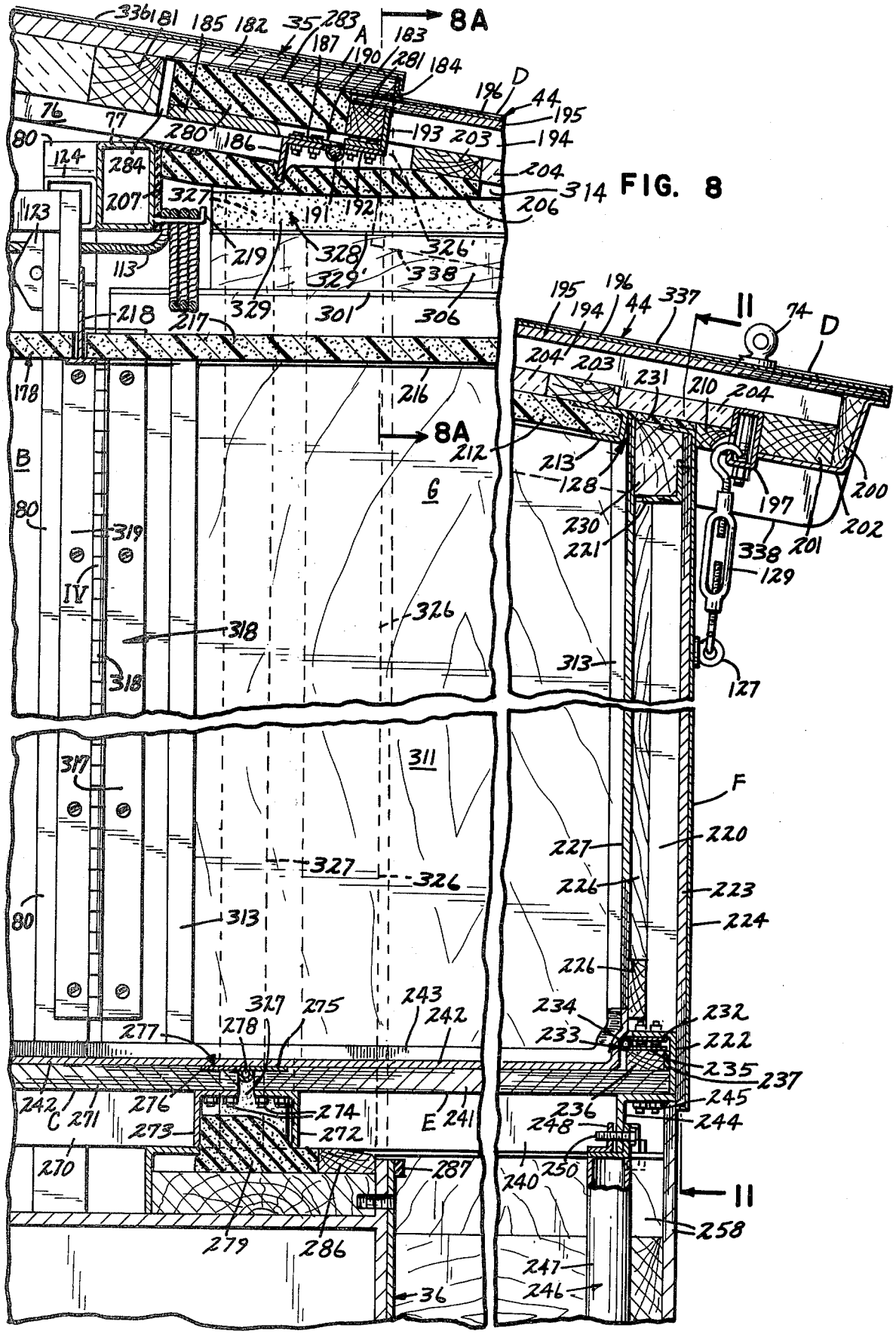
FIG. 8 is an enlarged fragmentary transverse sectional view along the line 8—8 of FIG. 3, but showing details of the structure in its expanded condition, to a larger scale, portions thereof being broken away.

When the procedure just described has been completed, end walls G are folded out to complete the ends of the expanded structure, as will be described in connection with FIG. 10, and element D is then lowered until a notch therein generally indicated by the numeral 128 engages the top of element F and retains the configuration while a plurality of securements 129, one of which is shown in FIG. 8, are made fast.

Figure 6:
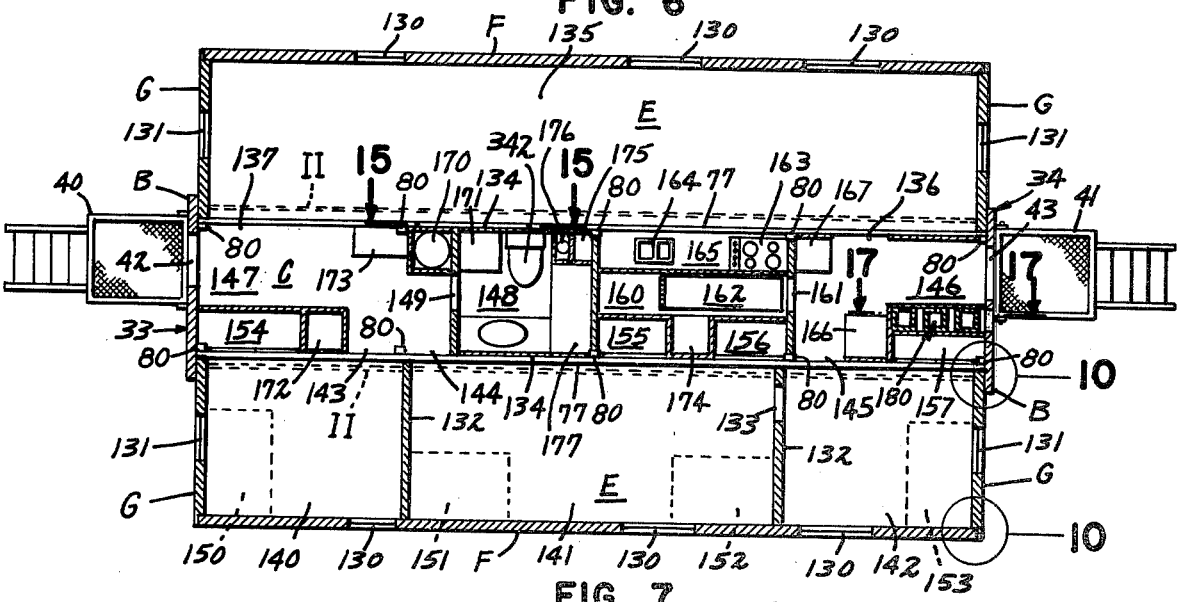
FIG. 6 is a plan view, in section along the line 6—6 of FIG. 3, and to the same scale, of the structure when expanded, showing a typical internal arrangement.

FIG. 6 is a plan view of the structure when expanded for use, showing a typical internal arrangement. As shown, walls F and G are provided with windows 130, 131 as desired. Similarly, internal partitions 132 may be hinged along vertical axes to posts 80 as desired, to sub-divide the expanded structure into distinct living areas: one of partitions 132 has a doorway 133 as the desired living plan of the expanded structure makes it desirable. Permanent partitions 134 are also provided within the central portion of the structure.

Merely by way of illustration, FIG. 6 shows a long living, dining, and kitchen area 135 having a front doorway 136 and a rear archway 137, three bedrooms 140, 141 and 142 having doorways 143, 144 and 145, first and second halls 146 and 147, and a bathroom 148 having a doorway 149 and the usual fixtures. Doors are not shown to avoid complicating the drawing. Beds 150–153 may be secured for travel in closets 154–157 opening into the bedrooms: other noncollapsible bedroom and living room furniture must be stored for travel in halls 146 and 147. A small closed compartment 160 having a doorway 161 is provided, for access to the plumbing and heating system of the structure through a trap door 162 in the floor. The usual kitchen stove 163 and sink 164 are mounted in an alcove 165 opening into area 135. A freezer-refrigerator 166 and a cabinet 167 for storage of kitchen equipment and supplies are located in hall 146, and a water heater 170 is located in hall 147, convenient to a stacked washer and dryer 171 in bathroom 148. Additional storage areas are shown at 172, 173, 174 and 175, and the furnace flue is shown at 176. As suggested in FIG. 5, a horizontal dropped ceiling 178 extends the full length of the permanent structure, to define thereabove a plenum for cooperation with ventilating apparatus 180, shown in FIG. 6 as positioned over closet 157 and described in more detail in connection with FIG. 17. Access to gear reducer 94 is available above bathtub 177.

Reference should now be had to FIG. 8. Central roof 35 (element A) is shown to comprise rafters 76 borne by plates 77 on posts 80, and carrying longitudinal purlins, one of which is shown at 181. The purlins in turn carry a main sheathing 182 to which sheet metal roofing 183 is secured in the usual fashion: a weather strip 184 is provided at the outer edge of this central roof. Extending along the upper surface of the outer ends of rafters 76 is a guide panel 185 of plywood, the upper surface of which is sanded and lubricated, as with soap, for a purpose presently to be described. An angle bar 186 is secured along the outer ends of rafters 76, and carries one leaf 187 of a continuous hinge 190 whose pintle 191 comprises axis I of FIGS. 18 and 19.

The other leaf 192 of hinge 190 is carried by an angle bar 193 secured to the upper ends of the transverse extension rafters 194 of folding roof element D. An extension sheathing 195 is carried by rafters 194 and is covered by metal roofing 196. The position of hoisting eye 74 is shown, as is that of a socket 197 for receiving securement 129. Filler strips 200 and 201 cooperate with a sheet metal end cap 202 to complete the eave of the folding roof.

Furring strips 203 are carried on the inner surfaces of rafters 194, and the spaces therebetween are occupied by insulating boards 204. A flexible foam sealing strip 206 is secured along one upper edge to the uppermost furring strip 203, and along the opposite upper edge to the undersurfaces of rafters 76 and to a sealing strip 207 secured to plate 77. An elongated socket corresponding to notch 128 of FIG. 5 is defined between a filler strip 210, secured to members 204 and 197, and a metal edging 211 carried by furring strip 203 and arranged to receive the lower edge of a ceiling panel 212 carried by a grid 213 which at this site is thus secured directly to members 203 and 204.

Figure 20:
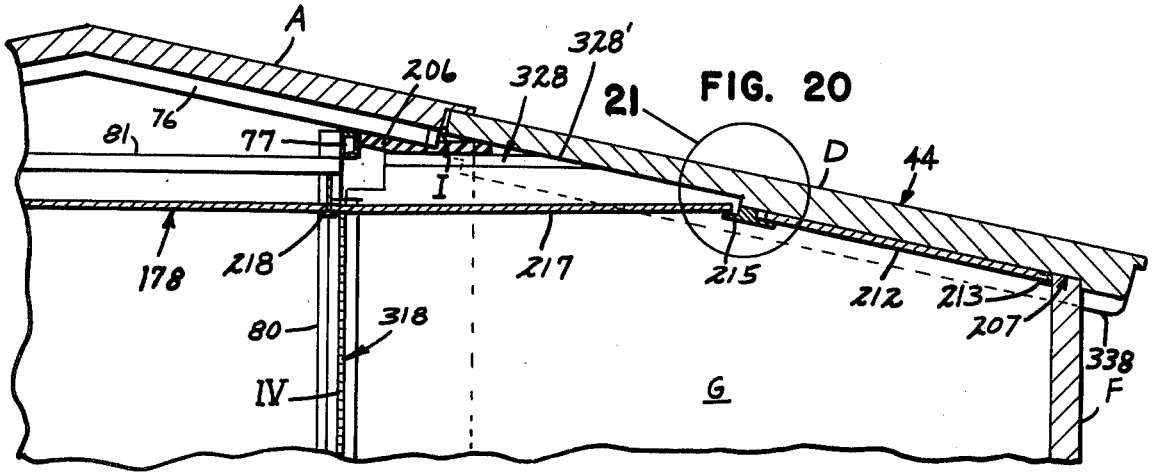
FIG. 20 is a diagrammatic transverse sectional view showing a dropped ceiling.

As shown schematically in FIG. 20, and in more detail in FIG. 21, the upper edge of grid 213 is supported from a member 213 by a suitable bracket 215, which also supports the grid 216 of one side section 217 of dropped ceiling 178: the other edge of grid 216 is supported on a conventional hanger 218, to be level with the rest of the ceiling.

FIG. 8 also shows that one or more hooks 219 may be affixed to plate 77 for hanging cables 111–115 inconspiciously in the space above section 217 of ceiling 178 when they are not being used.

Figure 10:
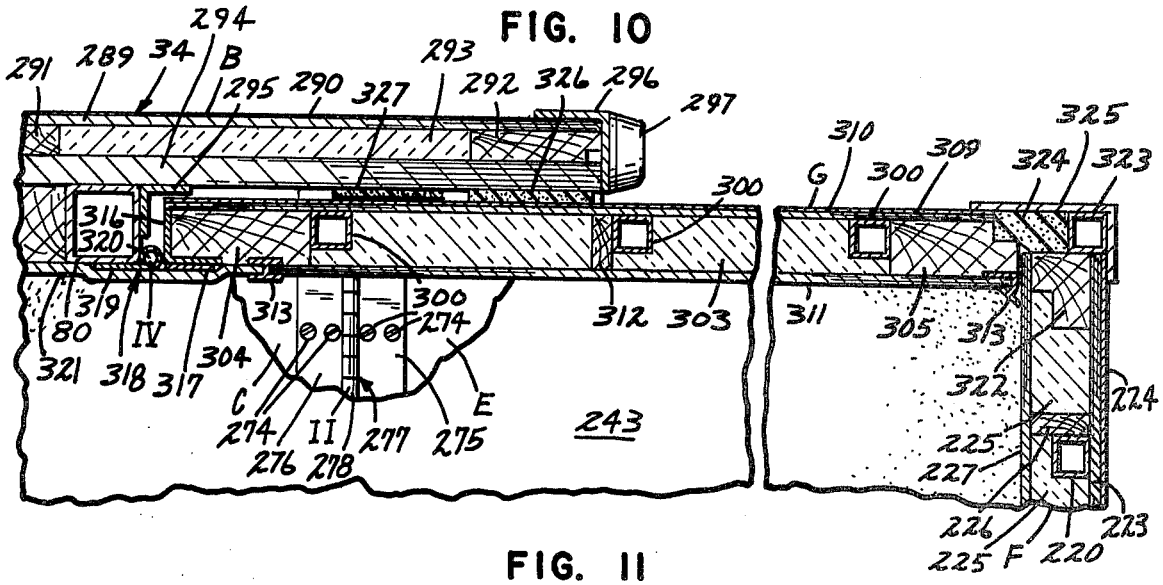
FIG. 10 is an enlarged horizontal sectional view of the portions of the structure indicated by the circles at 10, 10 in FIG. 6.

Wall F is shown in FIGS. 8 and 10 to comprise studs 220 joined at the top by an angle bar 221 and at the bottom by an angle bar 222. Sheathing 223 is secured to the outsides of studs 220, and covered with sheet metal siding 224. Insulation board 225 is secured to the insides of studs 220 between furring strips 226, and overlaid with finished panelling 227. A filler strip 230 at the top of the wall functions in part as a furring strip to support panelling 227, and in part as a rail, covered with suitable padding tape 231, to be received in socket 128 for stablizing folding wall F with respect to folding roof D. Angle bar 222 is secured to one leaf 232 of a continuous hinge 233 whose pintle 234 comprises axis III of FIGS. 18 and 19: the other leaf 235 of hinge 233 is secured to a sill 236 having a foam weatherstrip 237.

Figure 14:
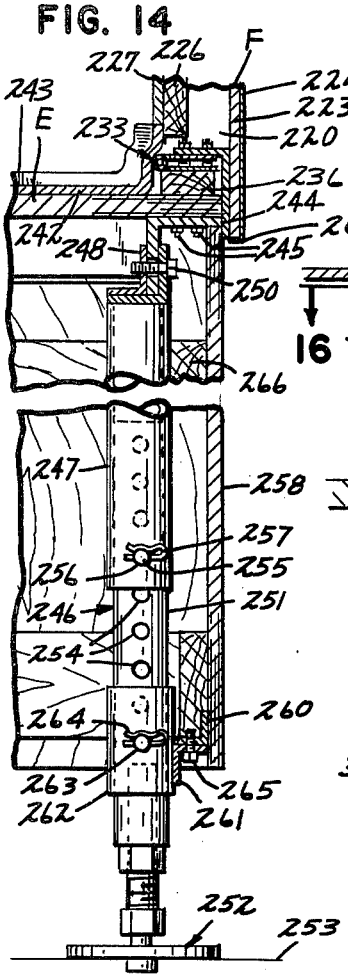
FIG. 14 is a fragmentary view partly in vertical section showing an outrigger support.

Folding floor E is shown in FIG. 8 to comprise joists 240 which support a subfloor 241, a carpet pad 242, and a carpet 243. An angle bar 244 is secured along the outer ends of joists 240, and positions sill 236 by fasteners 245 passing through subfloor 241: it is arranged to receive at desired locations therealong a suitable number of adjustable support legs 246, better shown in FIG. 14. Each leg comprises an outer tube 247 having an end bracket structure 248 for connection to an angle bar 244 by a suitable fastener 250, and an inner cylinder 251 having a screw adjusted foot 252 for engaging the ground 253. Member 251 is provided with a plurality of diametrical apertures 254 anyone of which can be aligned with a pin 255 passing through a single diametrical aperture 256 in member 247, and secured by a hair pin 257. A skirting 258 may be supported on members 251 if desired, by appropriate means such as brackets 260 and 261 carried respectively by skirting 258 and a collar 262 adjustable on member 255 by a diametrical pin 263 and hairpin 264, the brackets being interconnected by a suitable fastener 265. The upper edge of skirting 258 may carry a filler strip 266, and may be held against outward movement by a downward projection 267 of sheathing 223.

Returning to FIG. 8, central floor C includes joists 270, subflooring 271, carpet pad 242 and carpet 243: joists 270 are suitably supported on undercarriage 36. A pair of angle bars 272 and 273 are secured to the adjacent ends of joists 240 and 270, respectively, and are connected, by fasteners 274 extending through the subflooring, to the leaves 275 and 276, respectively, of a continuous hinge 277 whose pintle 278 comprises axis II of FIGS. 18 and 19. A pad 279 of foam material acts as a dust seal at hinge 277.

Figure 9:
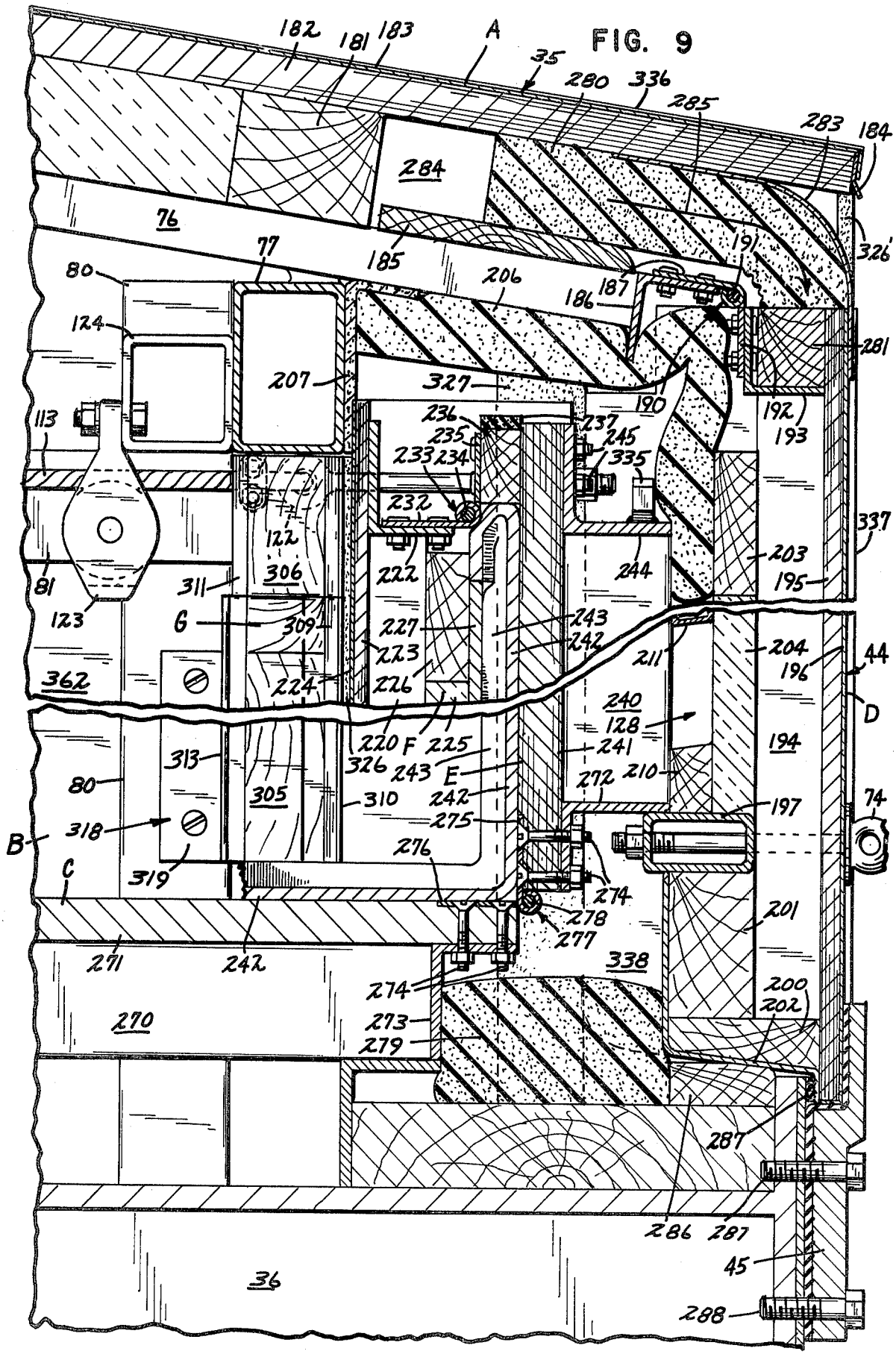
FIG. 9 is a view similar to FIG. 8 to a still larger scale of the same portion of the vehicle in its collapsed condition, portions thereof being broken away.

The sealing function between folding roof D and center roof A will now be described: this is accomplished by a batt 280 of foam material, one end of which is cemented to the end of sheathing 195 and to a filler strip 281 supported by angle 193. The batt is sized in thickness to fit in the space between guide panel 185 and roof sheathing 182, its upper or outer surface being for the most part cemented to a flexible metal sheet 283 secured to sheathing 195 at one end over roofing 196. Members 283 and 280 are free to slide and flex as folding roof D is lowered and raised. FIG. 9 shows that when the structure is collapsed the movement of batt 280 increases the space 284 between purlin 181 and the end of batt 280, which slides in the direction of arrow 285 on the soap-lubricated upper surface of panel 185 while retaining a weather and dust tight seal around hinge 190.

FIG. 9 also shows that when folding roof D is folded down, end cap 202 engages a strike 286 in undercarriage 36 to support the roof, and also engages one edge of pad 279 and a further undercarriage pad 287. Clips 45 are shown as retaining the folding roof in this position, and as being held to undercarriage 36 by suitable fasteners 288. At the same time, sealing strip 206 has been folded, and is engaged at one end by angle bar 244, to retain a seal around hinge 233.

As shown in FIG. 10, central end B may comprise a sheathing 289 of plywood faced with metal siding 290 and separated by a frame of wood members 291, 292 and a layer 293 of suitable insulating material from an inner plywood layer 294. End B is supported on posts 80, as by brackets 295, and is finished by a sheet metal trim angle 296 which carries clearance lights 297.

Figure 11:
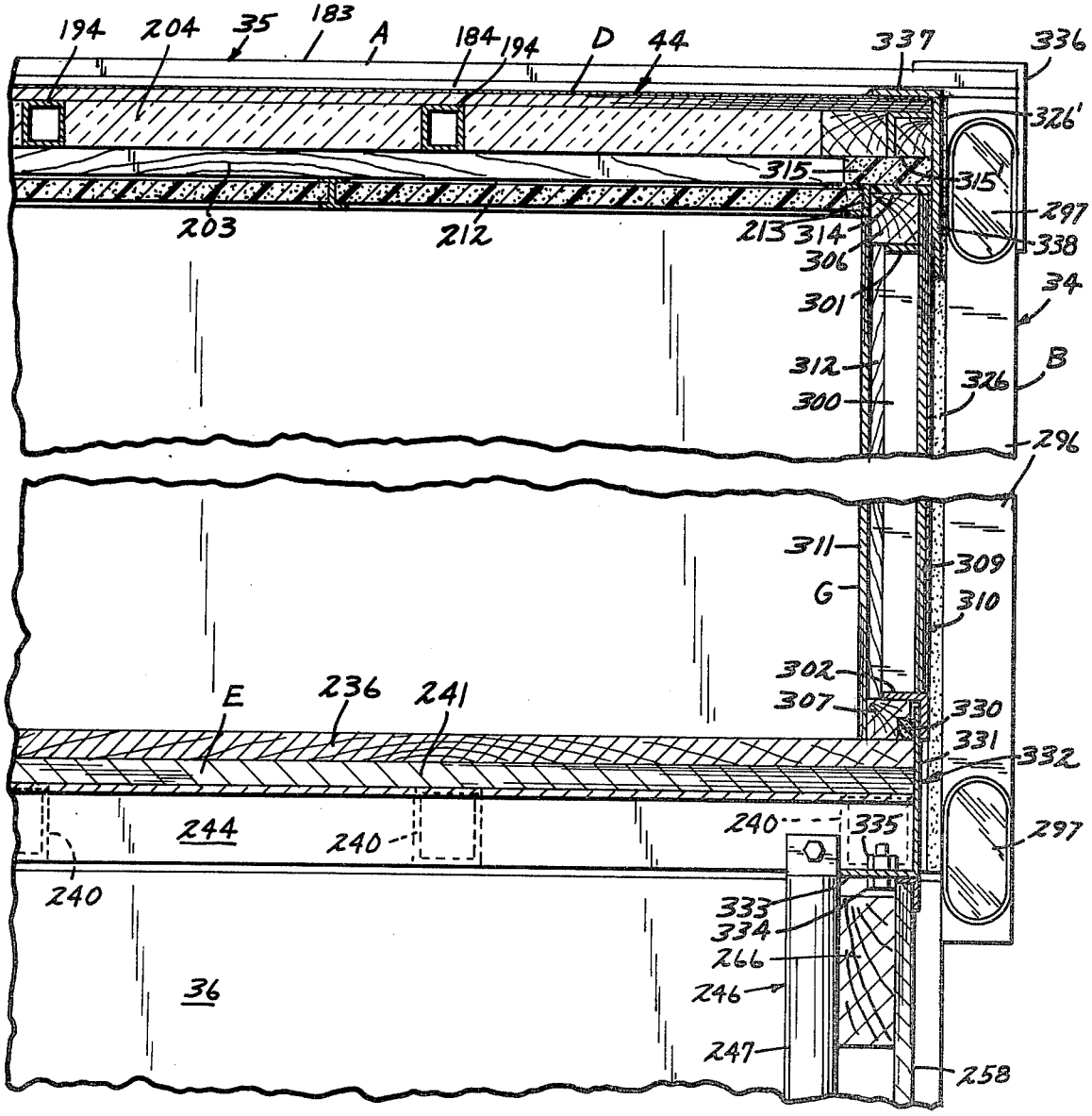
FIG. 11 is a sectional view generally along the irregular line 11—11 of FIG. 8, parts being omitted.

Folding end G is shown in horizontal section in FIG. 10 and in vertical section in FIG. 11. It comprises a plurality of square tubular steel studs 300 joined along their tops by a plate 301 of steel strap, and along their bottoms by a sill 302 of angle bar. The spaces between the studs are filled with insulation panels 303, wooden studs 304 and 305 being provided at the inner and outer ends, and wooden furring strips 306 and 307 are provided at the top and bottom. The wall is completed by a sheathing 309 faced with metal siding 310, and an inner panel 311, the latter carried on furring strips 312 on studs and supported by the usual hangers 313. A cap strip 314 is provided between members 306 and 309 below and a strike strip 315 of styrofoam inserted in a notch 315' in folding roof D beside insulation board 204 and furring strip 203.

Stud 304 is reinforced by an angle bar 316 to which is secured one leaf 317 of a continuous hinge 318 having a second leaf 319 secured to post 80, and a pintle 320 which comprises the pivotal axis IV of FIGS. 18 and 19. Hinge 318 is spanned by a strip of flexible batting 321 to seal this joint.

Folding wall F is shown in FIG. 10 to have at its end a vertical wooden member 322 reinforced by a tubular steel post 323. Foam weather stripping 324 is secured to members 322 and 323 for sealing engagement by member 305 of folding end G, and the corner is finished by a trim angle 325. Weather strip 326 is also provided on the outer surface of folding wall G, where it engages the inner surface of central wall B, and a strip 327 of cap tape may also be provided.

In order to complete the seals between wall B, wall G, and roof D, an extension 326' of weather strip 326 is secured to the inner surface of wall B near its top, as shown in FIGS. 8, 8A and 9, and a removable filler member 328, tapered at one end 328', is insertable on top of filler strip 306 to engage foam strip 206 as shown in FIGS. 8 and 8A. Member 328 comprises a styrofoam body 329 and a weather strip 329'.

Referring again to FIG. 11, it will be seen that a space is provided between furring strip 307 and angle sill 302. This space is in part filled by a foam strip 330, which sealingly engages one leg 331 of a removable locking angle 332, the other leg 333 of which is secured to folding floor E by a bolt 334 passing through a captive nut 335. Locking angle 332 is positioned manually after folding end G has been opened and before skirting 258 is applied, to prevent inadvertent pivotal movement of end G, and to give a weather-tight joint between it and folding floor E.

As is also shown in FIGS. 10 and 11 the upper edges of central wall B and folding roof D are finished by trim angles 336 and 337. Near its inner end one leg of angle 337 is somewhat extended, as at 338, FIG. 8, to complete the weather-tightness of the enclosure.

FIG. 10A shows in horizontal section the portion of the structure indicated by the circle 10A in FIG. 6 when the structure is collapsed. Folding end G has been folded in, folding wall F has been folded down against folding floor E, which has been raised with wall F, and folding roof D has been folded down. The various components are given the same numerals as in previous figures. Shown only in this figure is a surface protection pad 339 which extends along short purlins 339' inset between floor joists 240 at a position where the pad engages sides 213 of ceiling 178. It is to be noted in this figure that the edge of leg 338 of trim angle 337 engages the outer edge of cap tape 327, compressing it slightly and forming a dust-tight seal the full height of central wall B from the end of pad 279 below to the end of pad 206 above.

Figure 15:
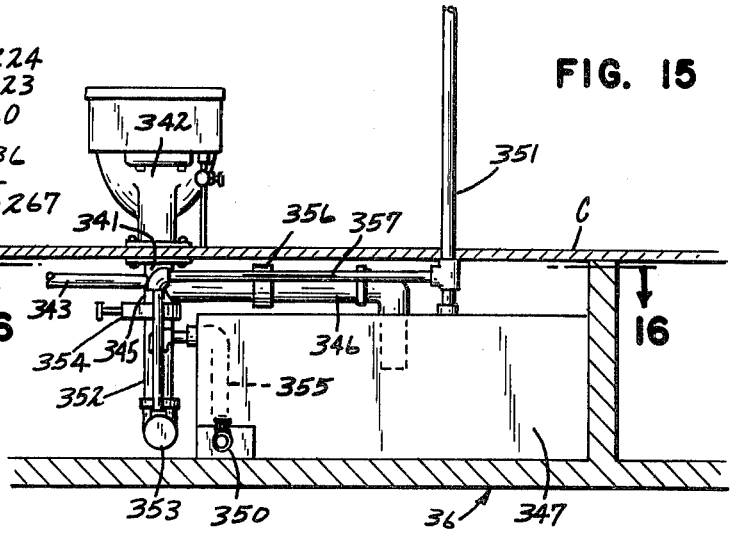
FIG. 15 is a fragmentary view in vertical section taken along the line 15—15 of FIG. 6, showing plumbing components of my mobile home.
Figure 16:
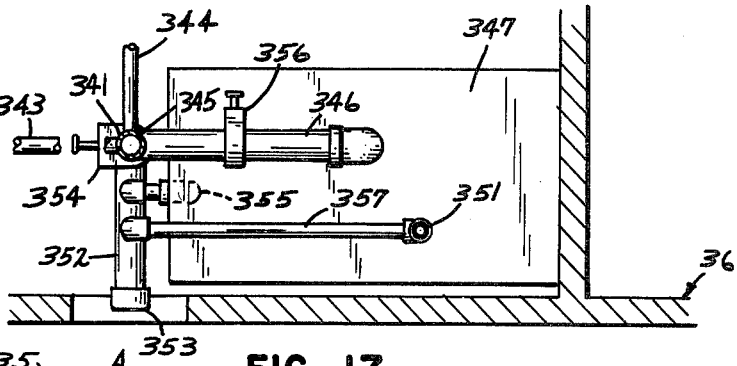
FIG. 16 is a fragmentary view in horizontal section taken along the line 16—16 of FIG. 15.

FIGS. 15 and 16 give details of the drainage system for the mobile home. As shown, a main drain 341 is connected to the toilet 342, and has branch connections 343, 344 to the bathtub, kitchen sink, washing machine, and so on. From a T connection 345 the drain is extended in a horizontal branch 346 into a waste or septic tank 347 having a drain cock 350. Tank 347 is built into the undercarriage 36 of the vehicle, and has a vent connection 351 extending to the central roof. From T connection 345 a second branch 352 extends downwardly and then horizontally to terminate in a cap 353, removable to give the system access to an external sewage disposal system when such is available. Branch 352 includes a gate valve 354 which can be opened to direct wastes to the external sewer system or closed to direct the wastes to tank 347 for storage, or for septic tank operation using an overflow 355. Similarly, branch 346 is provided with a valve 356 which is to be opened when 354 is closed, and vice versa. Vent pipe 351 is extended at 357 to branch 352.

Figure 17:
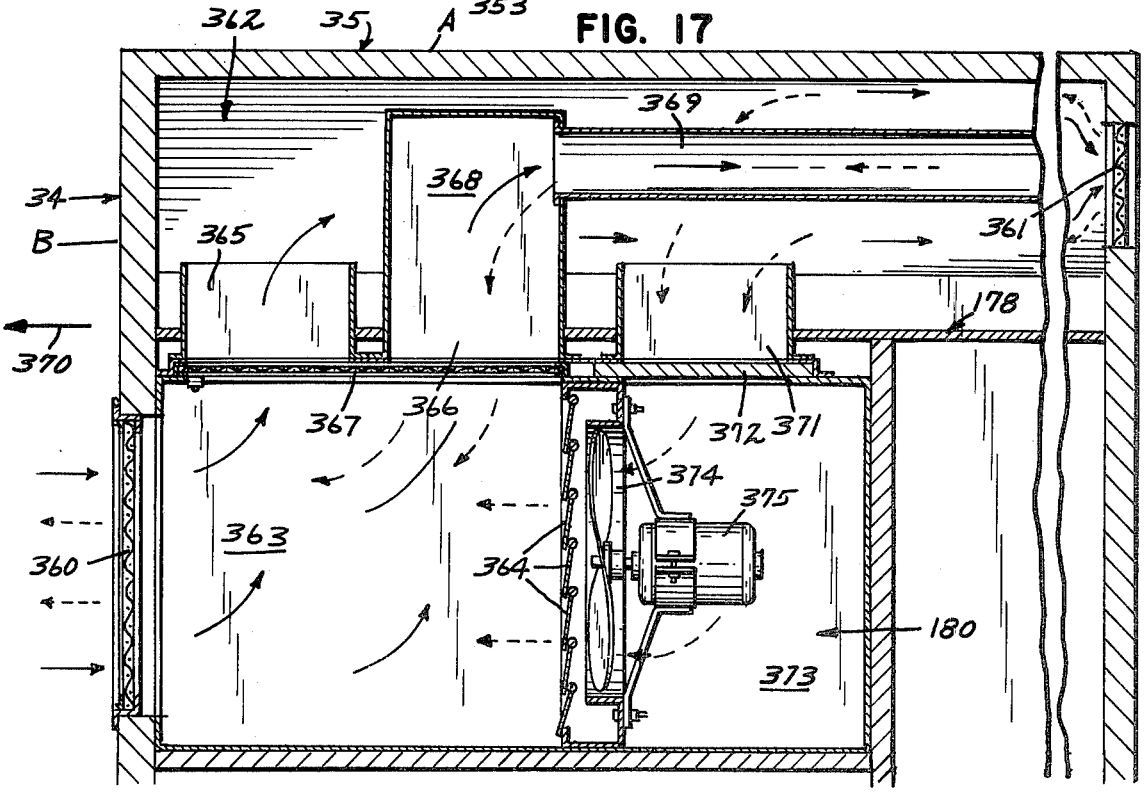
FIG. 17 is an enlarged fragmentary detail view partly vertical in section, taken along the line 17—17 of FIG. 6, showing ventilation components of the mobile home.

An important part of the mobile home centers around ventilating apparatus 180, disclosed in FIG. 17. As previously mentioned, the space above dropped ceiling 178 functions as the plenum for ventilation of the mobile home, and the ceiling may be provided with appropriate vents opening into the living space at suitable locations. In addition, individual vents with exhaust fans are provided in the kitchen and bathroom areas, as is conventional in residences generally. A filtered vent 360 to the ambient air is provided at the front of the structure, and a smaller filtered vent 361 is provided at the rear of the structure. The latter vent communicates directly with the plenum space, identified in FIG. 17 by numeral 362, above the dropped ceiling: and the former vent communicates with a plenum 363, one wall of which is provided with louvers 364 preventing flow of air outwardly from the plenum. A pair of apertures 365 and 366 in the top of plenum 363, having a common filter 367, gives access respectively, to space 362 and to a smaller plenum 368 connected by a duct 369 to the kitchen and bathroom vents.

When the structure is in transit, in the forward direction indicated by the arrow 370, relative wind impacts on vent 360 and causes flow of air in the directions of the solid arrows in FIG. 17, to build up a slight positive pressure in the structure, the excess of air flowing out at smaller vent 361. A further aperture 371 out of space 362 is at this time closed by a sliding panel 372, to prevent flow of air into a further plenum 373 having an outlet 374 in which is suspended a blower or fan 375 effective when operative to direct air through louvers 364, which are arranged to permit this.

When the structure is in residence use, filter 367 is removed and panel 372 is slid forward until it closes aperture 365. Now when fan 375 and the kitchen and bathroom fans are energized, air flows in the system as is shown by the broken line arrows in FIG. 17. Air is drawn from the kitchen and bathroom area vent fans, passing through duct 369, plenum 368, and aperture 366 to plenum 363: simultaneously, air is drawn through vent 361, space 362, aperture 371, plenum 373, fan 375, aperture 374, and louvers 364 to plenum 363. That plenum exhausts through vent 360 to the ambient atmosphere.

OPERATION

Consider first the state of the structure when expanded for residence: see FIGS. 8 and 10. At this time the ventilation system is as shown in broken line arrows in FIG. 17, and the exhaust fans and fan 375 may be on or thermostatically controlled. The hinged joints between the central roof A and the folding roofs D are doubly sealed by members 206 and 280. The secured joints between the folding roofs D and the tops of the folding sides F are sealed by members 231. The hinged joints between the folding floors E and the folding walls F are sealed by members 237 and by carpet 243 and pad 242. The hinged joints between the central floor C and the folding floors F are sealed by members 279. The joints between the folding floors F and the folding ends G are sealed by members 330. The joints between the folding ends G and the folding sides F are sealed by members 324. The joints between the folding ends G and the folding roofs D are sealed by members 314 and 315. The hinged joints between the folding ends G and the central ends B are sealed by members 321, 326, and 326'. There are thus no unsealed crevices through which conditioned air can leak from the structure or through which dust can be carried into the structure.

Now consider the state of the structure when collapsed for transport: see FIGS. 9 and 10A. The ventilation system is now in the solid arrow condition of FIG. 17. The hinged joints between the central roof A and the folding roofs D are doubly sealed, as before, by members 206 and 280. The joints between folding roofs D and the center floor C are sealed by members 279 and 287. The joints between folding roof D and central ends B are sealed by members 327 and 338. The joints at hinges 233, 277, and 318 are all contained within the seals just named. Again, there are no unsealed crevices, for entrance of rain, snow, or road dust, particularly since the impact air entering the structure at filter 360 maintains a small positive internal pressure therein.

From the foregoing it will be evident that I have invented a new and useful expandable mobile home in which every joint, hinged or otherwise, between the fixed and movable portions is sealed against ingress of ambient air, dust and moisture, and against egress of conditioned air, whether the structure is in transport or residence use, and which particularly embodies a joint in which a sealing batt may flex and slide to maintain the tightness between a central roof and a folding roof movable with respect thereto.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A mobile home comprising, in combination:

a plurality of horizontally aligned longitudinally spaced vertical posts;

a horizontal beam connected to the outer faces of said posts at their tops;

a plurality of spaced sloping main rafters supported near first, outer ends by said beam, and projecting outwardly therebeyond;

horizontally extended purlins secured on said rafters, an outermost of said purlins being spaced inwardly from the outer ends of said rafters;

a main sheathing secured on said purlins and having an edge extending outwardly beyond the outer ends of said rafters to constitute with said purlins and said rafters a main roof;

a guide panel secured on said rafters outwardly of the outermost purlin and inwardly of the outer edge of sheathing to define with said sheathing a longitudinally extending weather sealer guide space;

a plurality of parallel extension rafters;

a second sheathing secured to outer surfaces of said extension rafters to constitute therewith a folding roof;

means hinging the outer ends of said main rafters to first ends of said extension rafters for pivoting about a common longitudinal axis, said axis being located outwardly from the ends of said main rafters and generally in a plane defined by their upper surfaces, and being spaced from the ends of said extension rafters and from the faces thereof which are free from sheathing;

a batt of flexible resilient insulating material such as polyurethane foam having one edge secured to the edge of said second sheathing adjacent to said axis, said batt extending into said guide space in sealing relation to said guide panel and said main sheathing;

and a strip of flexible impervious material extending along the edge of said second sheathing and overlying at least a portion of the width of said batt, and fastened to the outer surface of said second sheathing and to the surface of said batt adjacent said main sheathing, so that when said extension roof is pivoted about said axis through approximately 90°, said batt and said strip flex and slide transversely in said guide space to comprise a weather sealer.

2. In a mobile home, in combination:

a sloping fixed roof including (a) a transverse set of main rafters;

(b) longitudinal purlins on said rafters, the lowermost purlin being spaced inwardly from the ends of said rafters, (c) a first sheathing on said main rafters, the edge of said sheathing extending beyond the ends of said rafters, and (d) a guide panel secured on said main rafters outwardly of said lowermost purlin and inwardly of the outer edge of said first sheathing to define with said sheathing a longitudinally extending weather sealer space;

a folding roof including (a) a transverse set of extension rafters and (b) a second sheathing on said extension rafters, the thickness of said folding roof being substantially the same as the thickness of said lowermost purlin;

means, including a continuous hinge secured along the lower ends of said main rafters and first end of said extension rafters, for pivotally interconnecting said fixed roof and said folding roof so that the latter is movable between a first, generally vertical position and a second position in which it is substantially parallel to and below said main roof;

and a weather sealer including (a) a batt of flexible resilient insulating material such as polyurethane foam having one longitudinal edge secured to the edge of said second sheathing adjacent to said axis, said batt extending laterally into said guide space in sealing relation to said guide panel and said first sheathing, and (b) a sheet of flexible impervious material fastened to the outer surfaces of the second sheathing and at least a portion of the surface of said batt adjacent said main sheathing, so that when said folding roof is pivoted about said axis through approximately 90° said batt and said strip flex and slide transversely in said guide space to comprise a weather sealer.

3. In a mobile home, in combination:

a sloping fixed roof including (a) a transverse set of main rafters, (b) longitudinal purlins on said rafters, the lowermost purlin being spaced inwardly from the ends of said rafters, (c) a first sheathing on said main rafters, the edge of said sheathing extending beyond the ends of said rafters, and (d) a guide panel secured on said main rafters outwardly of said lowermost purlin and inwardly of the outer edge of said first sheathing to define with said sheathing a longitudinally extending weather sealing space;

a folding roof including (a) a transverse set of extension rafters, and (b) a second sheathing on said extension rafters, the thickness of said folding roof being substantially the same as the thickness of said lowermost purlin;

means, including a continuous hinge secured along the lower ends of said main rafters and first ends of said extension rafters, for pivotally interconnecting said fixed roof and said folding roof so that the latter is movable between a first, generally vertical position and a second position in which it is substantially parallel to and below said main roof;

a longitudinal strip of foam material secured along one edge to the undersurfaces of said main rafters and along the other edge to the undersurfaces of said extension rafters, to extend across and seal the hinged joint between said main roof and said folding roofs;

and a weather sealer including (a) a batt of flexible resilient insulating material such as polyurethane foam having one longitudinal edge secured to the edge of said second sheathing adjacent to said axis, said batt extending laterally into said guide space in sealing relation to said guide panel and said first sheathing, and (b) a sheet of flexible impervious material fastened to the outer surface of the second sheathing and at least a portion of the surface of said batt adjacent said main sheathing, so that when said folding roof is pivoted about said axis through approximately 90° said batt and said strip flex and slide transversely in said guide space to comprise a weather sealer.

* * * * *